US006823164B2

(12) United States Patent
Tatsumi

(10) Patent No.: US 6,823,164 B2
(45) Date of Patent: Nov. 23, 2004

(54) BLADE FOR A DEVELOPING DEVICE

(75) Inventor: Hiroshi Tatsumi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/420,908

(22) Filed: Apr. 23, 2003

(65) Prior Publication Data

US 2003/0235438 A1 Dec. 25, 2003

(30) Foreign Application Priority Data

Apr. 23, 2002 (JP) ..... 2002-120908

(51) Int. Cl.[7] ..... G03G 15/08
(52) U.S. Cl. ..... 399/284; 399/274
(58) Field of Search ..... 399/284, 274

(56) References Cited

U.S. PATENT DOCUMENTS 5,937,253 A * 8/1999 Shimazaki et al. ..... 399/284
6,330,416 B1 * 12/2001 Yamada et al. ..... 399/284
6,603,944 B2 * 8/2003 Tatsumi ..... 399/284

FOREIGN PATENT DOCUMENTS

JP 5-323778 A 12/1993
JP 10-260159 A 9/1998
JP 2001-92248 A 4/2001

* cited by examiner

*Primary Examiner*—Quana Grainger
(74) *Attorney, Agent, or Firm*—Birch, Stewart, Kolasch & Birch, LLP

(57) ABSTRACT

A non-magnetic mono-component developing device of the present invention can create a toner layer having a uniform thickness with uniform static charge characteristics across the full range of the image forming area on the peripheral surface of the developing roller, so as to form images of good quality, and includes a doctor blade which has a distal end as a free end, extended to the upstream side with respect to the direction of rotation of the developing roller and can regulate the thickness of the toner layer by abutting part of the side flat surface of the distal end portion against the peripheral surface of the developing roller, and is characterized in that the doctor blade has, at its distal end, an extension projected in the tangent direction from the abutment S and a bent portion (bent angle θ) angled so as to be positioned away from the peripheral surface, and Z is specified so as to satisfy the following relation:

$$0<Z\leqq[(Rr+4\times\phi t)^2-Rr^2]^{1/2},$$

where Z represents the length of the extension from the abutment point S to the bent portion, Rr the radius of the developing roller, and φt the mean particle size of the toner.

8 Claims, 8 Drawing Sheets

BLADE FOR A DEVELOPING DEVICE

BACKGROUND OF THE INVENTION (1) Field of the Invention

The present invention relates to a non-magnetic mono-component developing device which supplies, in the correct manner, a non-magnetic mono-component toner to the photoreceptor surface, by forming a thin layer of the toner on the developing roller surface. More detailedly, the present invention relates to a non-magnetic mono-component developing device which, upon development, creates a thin layer of the toner by regulating the amount of toner adhering to the peripheral surface of the developing roller, with a doctor blade which is arranged with its free end directed toward the upstream side with respect to the rotational direction of the developing roller.

(2) Description of the Prior Art

Generally, an electrophotographic image forming apparatus develops an electrostatic latent image formed on the photoreceptor surface by making use of the photoconductive effect, into a visual toner image, which in turn is transferred onto a recording medium, thus forming an image. Therefore, the image forming apparatus includes a developing device for supplying the toner (developer) to the static latent image formed on the photoreceptor surface.

The developing device is comprised of a developing roller and a toner storage hopper. The developing roller is configured so as to rotate and arranged so that its peripheral surface opposes the photoreceptor surface. The developing roller bears the toner in the storage hopper on its peripheral surface and supplies it to the photoreceptor surface. In particular, in a developing device for supplying a non-magnetic mono-component toner to the photoreceptor surface, a doctor blade is arranged on the peripheral surface of the developing roller. This doctor blade is put in sliding or pressing contact with the peripheral surface of the developing roller with the toner held therebetween, so as to regulate the thickness of the toner layer over the peripheral surface.

In the non-magnetic mono-component developing device, the condition of toner supply to the photoreceptor surface changes depending on the thickness of the toner layer attached on the peripheral surface of the developing roller. The thickness of the toner layer is determined by the state of abutment (including the state of proximity) between the peripheral surface of the developing roller and the doctor blade. This means that image forming is dominated by the state of abutment of the doctor blade against the peripheral surface of the developing roller.

In a developing device disclosed in Japanese Patent Application Laid-open Hei 5 No.323778, the distal part of the doctor blade is bent at an angle ranging from 0° C. to 90° in a direction away from the developing roller surface. This doctor blade is extended approximately along the tangent of the roller surface so that the angled distal part is located on the downstream side with respect to the developing roller's direction of rotation. In this arrangement, the doctor blade abuts the peripheral surface of the developing roller so as to adjust the toner layer to the correct thickness. The disclosure of this conventional doctor blade, however, has no reference to the influence from the R-value(radius of curvature) at the bent portion.

Japanese Patent Application Laid-open No.2001-92248 discloses a doctor blade configuration in which the distal part of the doctor blade is bent at an angle equal to or greater than 90° so that the bent portion regulates the toner. In this disclosure, the suitable range of the R-value of the bent portion is specified to be from 0.25 to 0.45 mm.

In the developing device using a non-magnetic mono-component toner, the behavior of the toner as a granular material exerts a large influence on formation of the toner layer. In a configuration in which the powdery toner layer is regulated by the bent portion, not only the R-value of the bent portion but also the surface properties (burrs and the like formed during bending) produce an effect on formation of the toner layer or formed images. In order to solve this problem, post-processes such as polishing the bent portion may and should be implemented, but this means addition of extra steps, leading to increase in cost.

In order to avoid the influence from the bent portion, it is possible to arrange the blade in such a manner that the blade comes into surface contact with the developing roller with its distal part extended to the upstream side with respect to the developing roller's direction of rotation. However, an excessive extension of the blade causes an excessive amount of toner to enter the space between the extension and the developing roller and push up the blade, resulting in degradation of the regulating force of the blade, which may cause difficulties in the uniform electrification of the toner and formation of the thin layer.

Further, though the optimal extension of the blade will also vary depending on the developing roller's diameter and the toner particle size, there have been no conventional developing devices which refer to this point. Hence, a solution to the problem of a uniformly charged thin layer of non-magnetic mono-component toner being unable to be maintained in a continuous manner has been awaited.

SUMMARY OF THE INVENTION

The present invention has been devised in order to solve the above problems, it is therefore an object of the present invention to provide a non-magnetic mono-component developing device which can create a toner layer having a uniform thickness with uniform static charge characteristics across the full range of the image forming area on the peripheral surface of the developing roller so as to form images of good quality.

The inventor hereof closely investigated and examined the relationship between the bent position of the doctor blade, the developing roller's diameter and the mean particle size of the toner, and found an appropriate relationship between these factors which enable the thickness of the toner layer on the peripheral surface of the developing roller and the charge-to-mass ratio of the non-magnetic mono-component toner to be set at correct values and which enable a correct amount of toner having proper static charge characteristics to be supplied to the photoreceptor surface, and finally has completed the present invention.

Specifically, the non-magnetic mono-component developing device according to the present invention is characterized by the following configurations or the following means and gives a solution to the above problems.

(1) A non-magnetic mono-component developing device, comprising:

a developing roller for supplying non-magnetic mono-component toner layered on the peripheral surface thereof to the photoreceptor surface as it being rotated; and a doctor blade which is cantilevered at its proximal end, has a distal end as a free end, extended to the upstream side with respect to the direction of rotation of the developing roller and can regulate the thickness of the toner layer by abutting part of the side flat surface of the distal end portion against the peripheral surface of the developing roller, characterized in that the doctor blade has, at its distal end, an extension projected in the tangent direction from the abutment S and a bent portion (bent angle θ) angled so as to be positioned away from the peripheral surface, and Z is specified so as to satisfy the following relation:

$$0<Z\leqq[(Rr+4\times\phi t)^2-Rr^2]^{1/2},$$

where Z represents the length of the extension in millimeters from the abutment point S to the bent portion, Rr the radius of the developing roller in millimeters, and ϕt the mean particle size of the toner in millimeters.

Here, 'abutment' should not be limited to the case where the blade comes into pressing contact with the roller with the toner held therebetween, but may include the case where the blade is arranged along and in indirect contact with the roller via the toner. That is, as long as the doctor blade can regulate the toner on the peripheral surface of the developing roller, the situation is considered as 'abutment'. In the present invention, the state of abutment in which the blade side is able to come into pressing contact with the roller surface with the toner held therebetween is preferred as described below.

(2) The non-magnetic mono-component developing device defined in (1), wherein the radius of curvature (R-value) at the bent portion is set within the range of 0.1 to 0.3 mm, and the length L from the bent portion to the distal end is equal to 0.5 mm or greater.

(3) The non-magnetic mono-component developing device defined in (1), wherein the relation holds:

$$\theta \geqq -2.5\times 2Rr+113,$$

where θ represents the bent angle of the bent portion in degrees and 2Rr the diameter of the developing roller in millimeters.

DESCRIPTION OF THE PREFERRED EMBODIMENTS

The preferred embodiment of a non-magnetic mono-component developing device according to the present invention will be described in detail with reference to the accompanying drawings. However, the non-magnetic mono-component developing device of the present invention should not be limited to the embodiment and examples hereinbelow.

Figure 1:
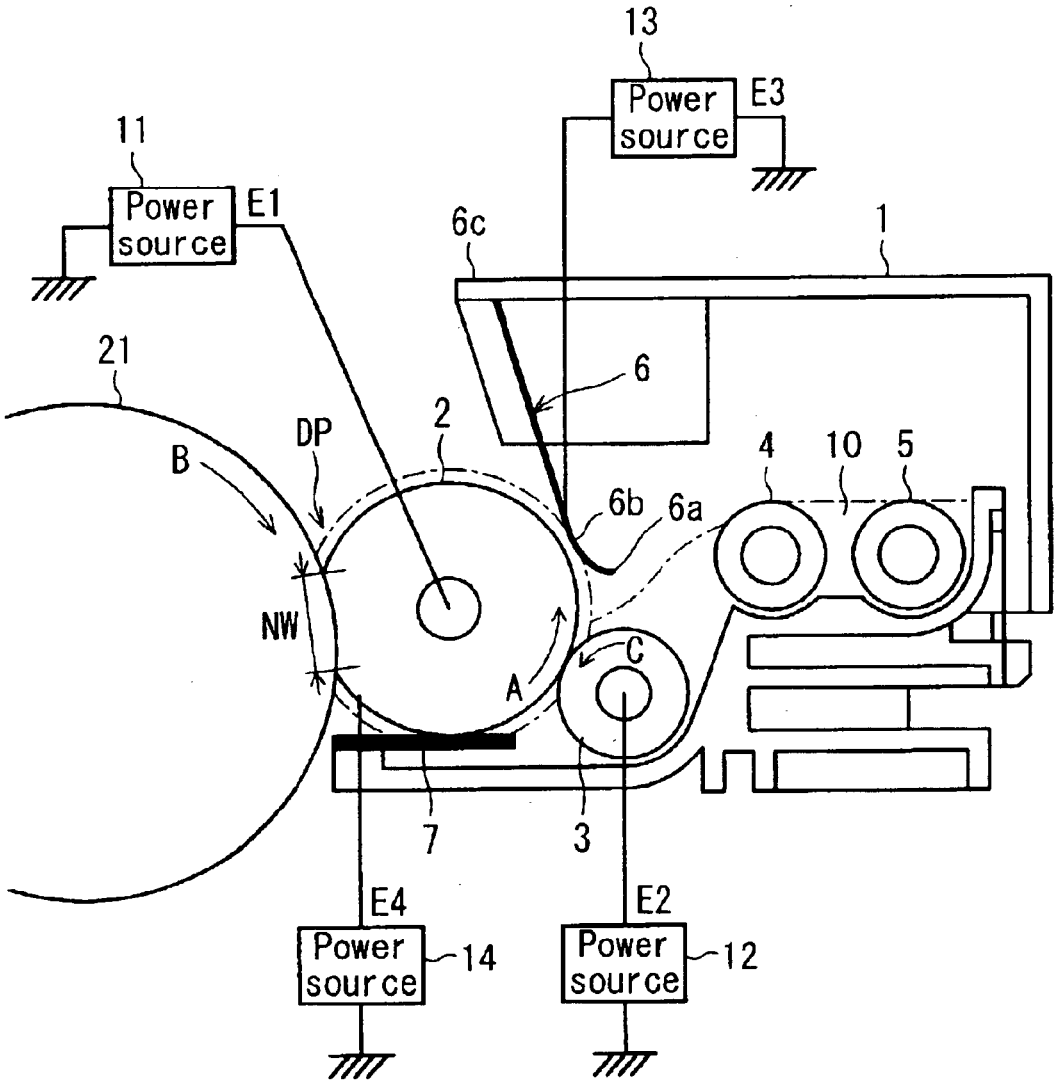
FIG. 1 is a sectional view showing the schematic configuration of a non-magnetic mono-component developing device according to the present invention.
Figure 2:
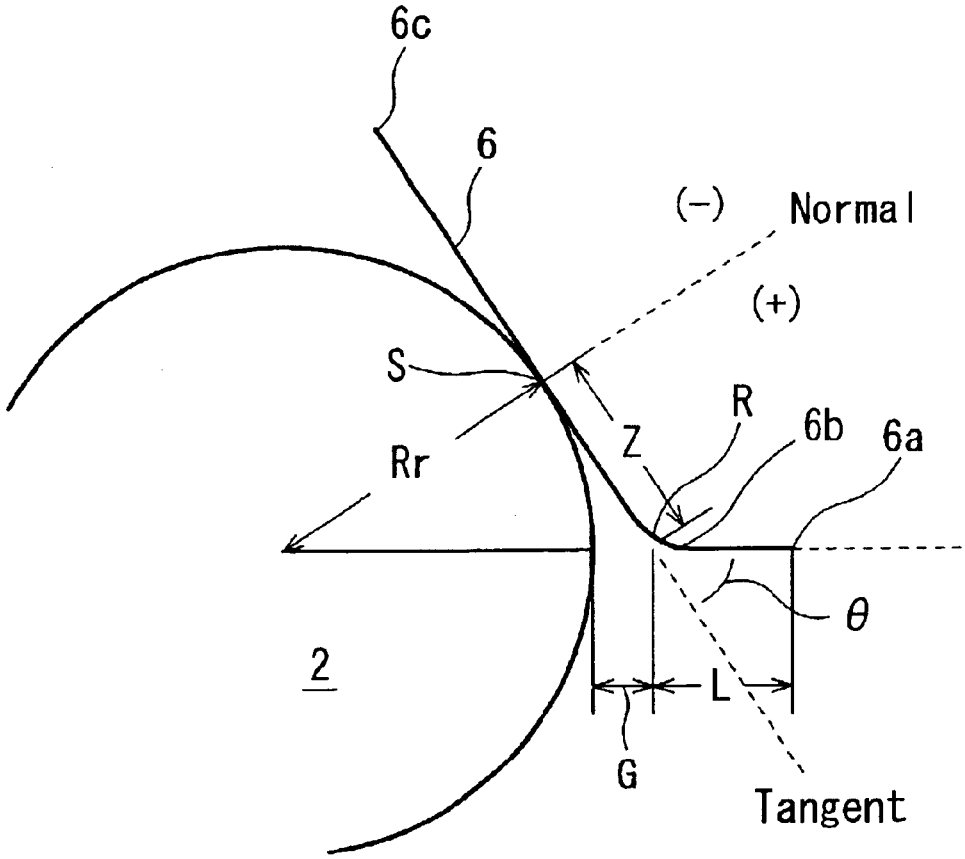
FIG. 2 is a view showing the state of abutment and positional relationship between the developing roller and the doctor blade in a non-magnetic mono-component developing device according to the present invention.

In the embodiment of a non-magnetic mono-component developing device according to the present invention shown in FIGS. 1 and 2, a developing device 1 includes a developing roller 2 supplying a non-magnetic mono-component toner to the photoreceptor 21 surface and a doctor blade 6 which is cantilevered at its proximal end 6*c*, has a distal end 6*a* as a free end, extended to the upstream side with respect to the direction of rotation of developing roller 2 (the direction indicate by an arrow A in FIG. 1) and can regulate the thickness of the toner layer by abutting part of the side flat surface of the distal end 6*a* portion against the peripheral surface of developing roller 2 with a predetermined pressing force.

As shown in FIG. 2, the portion at distal end 6*a* of doctor blade 6 has an extension Z projected from the abutment S with the peripheral surface in the tangent direction and a bent portion (bent angle θ) angled with a predetermined R-value(radius of curvature of 0.2 mm in FIG. 2) so as to be positioned away from the peripheral surface of developing roller 2 with respect to the tangent.

Where Z represents the length in millimeters of extension from the abutment point S to the bent portion, Rr the radius of the developing roller in millimeters, and ϕt the mean particle size of the toner in millimeters, Z is specified so that the following relation holds:

$$0<z\leqq[(Rr_+_4\times\phi t)^2-Rr^2]^{1/2}.$$

Describing the developing device 1 of the embodiment of the present invention in a more detailed manner, developing device 1 incorporates developing roller 2, a conveying roller 3, agitating rollers 4 and 5, doctor blade 6 and a sealing member 7, and stores a non-magnetic mono-component toner (which will be merely referred to as toner) 10. Developing device 1 is disposed between the exposure station and transfer station in the arrangement for the image forming process inside the image forming apparatus, with part of the periphery of developing roller 2 opposing the photoreceptor drum 21 surface. Developing roller 2 and conveying roller 3, doctor blade 6 and sealing member 7 have bias voltages E1 to E4 applied thereto from power circuits 11 to 14, respectively.

Inside developing device 1, toner 10 is agitated by agitating rollers 4 and 5 and fed to the peripheral surface of developing roller 2 by means of conveying roller 3 which turns in the direction of an arrow C in FIG. 1. Developing roller 2 with its peripheral surface constituted of an elastic material rotates at a fixed rate in the direction of arrow A in FIG. 1, and comes into pressing contact with the surface of photoreceptor drum 21 with a predetermined nip width NW in the developing area DP. Doctor blade 6 cantilevered by the inner wall of the developing device 1 body is arranged in such a manner that its distal end 6*a* portion presses the peripheral surface of developing roller 2, holding toner 10 therebetween. By this arrangement, a toner layer of a predetermined thickness is formed on the peripheral surface of developing roller 2. Here, sealing member 7 is put in pressing contact with the peripheral surface of developing roller 2 so as to prevent toner 20 held in developing device 1 from leaking out from the lower side of developing roller 2.

Developing device 1 supplies toner 10 via the peripheral surface of developing roller 2 to the photoreceptor drum 21 surface on which a static latent image is formed by the photoconductive effect as light of an image illuminates it in the exposure step, whereby the static latent image is made into a visual toner image. The toner image supported on the photoreceptor drum 21 surface having passing through the developing area DP as the drum rotates in the direction of an arrow B in FIG. 1 is transferred to the recording medium surface by an unillustrated transfer station.

The visual condition of the static latent image, i.e., the toner image, on the photoreceptor drum 21 surface is affected by the supplied amount and electric properties of the toner in the developing area DP. The supplied amount and electric properties of the toner in the developing area DP are determined by the condition in which the toner adheres to the peripheral surface of developing roller 2, or the formed condition of the toner layer. The formed condition of the toner layer on the peripheral surface of developing roller 2 is mainly determined by the abutment state of doctor blade 6 against the peripheral surface of developing roller 2. Thus, the toner image on the photoreceptor 21 surface is affected by the abutment state of doctor blade 6 against the peripheral surface of developing roller 2.

As shown in FIG. 2, the distal end 6*a* portion of the cantilevered doctor blade 6 is bent at a bent portion 6*b* a predetermined angle θ in the direction away from the peripheral surface of developing roller 2 with respect to the tangent. The bent portion 6*b* is formed with an optimal radius of curvature R (FIG. 2 shows a case where R=0.2 mm). Doctor blade 6 is configured so as to create a nip of a predetermined contact width with the peripheral surface of developing roller 2, with an extension Z from the intersection S (abutment point) between the normal of developing roller 2 that is perpendicular to the doctor blade and the peripheral surface of developing roller 2, assuming that any the extension upstream is positive (+) and any extension downstream is negative (−), with respect to the rotation of developing roller 2.

Concerning the relationship between the length of extension Z, the radius Rr of developing roller 2 and the open distance G at the toner entrance, in particular, the behavior of toner depending on the open distance G is estimated based on the knowledge of powder engineering. For example, it is believed that, when a large amount of particles are stored in the conventional hopper, the open distance in the conventional hopper needs to be equal to or greater than six times the particle size in order to flow the particles at a fixed rate through the toner entrance on the lower side. That is, if the open distance is equal to or greater than the toner particle size, the particles form arch-like structures and clog the opening of the toner entrance unless the above condition is satisfied.

However, in developing device 1, the layer of toner particles conveyed onto the developing roller 2 surface pass through the area between developing roller 2 and doctor blade 6 as it receives shearing stress by the conveying force from developing roller 2 and the regulating force from doctor blade 6. If aforementioned distance G, i.e., the toner entrance space is too large, an excessive amount of toner would flow in, causing difficulty in forming a stable thin layer of the toner. On the other hand, when the aforementioned open distance G is zero, which means that the extension Z is equal to or smaller than 0, blade 6 is pushed up due to the space defined by the R-value or the radius of curvature of bent portion 6*b*, so that toner can pass therethrough and produce a toner layer of an appropriate thickness. However, the formation of the toner layer in this case is susceptible to the R-value and the surface properties of bent portion 6*b*, hence this also causes problems. As a result, the length of extension Z is preferably greater than 0.

Developing device 1 according to he present invention is characterized in that the following relation holds:

$$0<Z\leqq[(Rr+4\times\phi t)^2-Rr^2]^{1/2}.$$

where Z represents the length in millimeters of extension from the abutment point S to the bent portion, Rr the radius of the developing roller in millimeters, an ϕt the mean particle size of the toner in millimeters.

The length of extension Z and the open distance G can be related by the equation $Z^2=(Rf+G)^2-Rr^2$, as shown in FIG. 2. Here, the open distance G can be designated appropriately in conformity with the diameter of development roller 2 as long as the open distance G is equal to or smaller than four times the particle size ϕt expressed in millimeters. Actually, from the result of the aftermentioned example shown in FIGS. 3 and 4, when the open distance G is set to be six times as large as the mean particle size of the toner or set at the same size as in the conventional hopper, an excessive amount of toner would flow in to raise the blade, increasing the thickness of the toner layer. On the other hand, when the open distance G is specified to be equal to or smaller than four times of the mean toner particle size ϕt, it is possible to obtain a stable toner layer thickness. The lower limit is the case where Z is greater than 0, as stated above.

It is preferred in non-magnetic mono-component developing device 1 of the present invention that the radius of curvature R of bent portion 6*b* of the doctor blade 6 is set within the range of 0.1 to 0.3 mm and the length L from bent portion 6*b* to the distal end is equal to 0.5 mm or greater.

As described below with reference to FIGS. 5 and 6, when the R-value of bent portion 6*b* of the doctor blade 6 is smaller than 0.1 mm, the stress of the distal part of the blade acting on the toner becomes large. On the other hand, when the R-value is greater than 0.3 mm, the range from which the toner enters becomes large, hence the restraining force of the blade 6 lowers.

Figure 6:
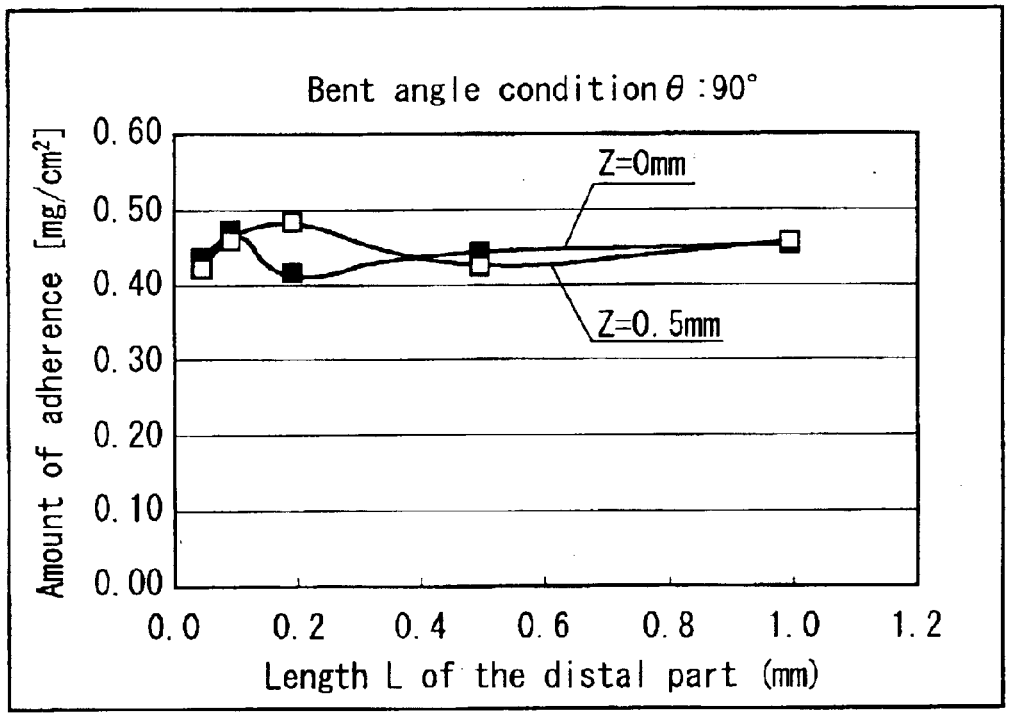
FIG. 6 is a chart showing the relationship between the length L from the bent portion to the distal end of the blade and the amount of toner adherence on the developing roller surface, in a non-magnetic mono-component developing device according to the present invention.

Further, as will be shown with reference to FIG. 6, when the length L from bent portion 6*b* to the distal end is set to be equal to 0.5 mm or greater, a satisfactory toner fluidity can be secured at the distal end of the blade and this setting also facilitates the bending process.

In the non-magnetic mono-component 1 according to the present invention, it is preferred that the following relation holds:

$$\theta\geqq-2.5\times2Rr+113,$$

where θ represents the bent angle of the distal end 6*a* portion of the doctor blade 6 and 2Rr the diameter in millimeters of developing roller 2.

The bent angle θ of bent portion 6*b* of the distal end 6*a* portion can be specified appropriately in accordance with the diameter of developing roller 2. Particularly, in the non-magnetic mono-component developing device, which uses a large diametric developing device 2, the bent angle θ of blade 6 is preferably smaller than 90°, as will be illustrated with reference to FIGS. 7 and 8. In this case, the range of curvature R of bent portion 6*b* becomes short, hence the influence can be minimized. That is, when the angle θ of the bent portion falls within the aforementioned range, it is possible to minimize the lowering of the regulating force of blade 6, which will occur when the radius of curvature (R) of the bent portion is too large, or the influence of the excessive stress acting on the toner, which will occur when the radius of curvature (R) is too small. As a result, the angle θ is preferably smaller than 90°.

EXAMPLES

The non-magnetic mono-component developing device according to the present invention will be further detailed taking examples.

In the examples herein, a developing device similar to the configuration described in the above embodiment with respect to FIGS. 1 and 2 was used to implement image forming hereinbelow.

Specifically, based on the developing device, the length of extension Z or the optimal open distance G (space) and the influence of the space on the toner layer over the developing roller were examined by the following measurement. As shown in Table 1, the measurement was implemented with three kinds of developing devices having different roller diameters.

TABLE 1

| Type | | Developing device 1a | Developing device 1b | Developing device 1c |
|---|---|---|---|---|
| Developing roller | Material | Conductive NBR rubber (with urethane coated on the surface) | Conductive urethane rubber | Conductive urethane rubber |
| | Diameter | 18 mm | 34 mm | 16 mm |
| | Peripheral speed | 225 mm/sec | 285 mm/sec | 175 mm/sec |
| Conveying roller | Material | Conductive silicone sponge roller | Conductive urethane foam | Conductive urethane foam |

As the non-magnetic mono-component toner used in the developing device, a negative charged toner mainly composed of thermoplastic resin such as polyester resin, styrene-acrylic copolymers and the like, having a mean particle size of 7.7 to 8.8 $\mu$m was used.

The doctor blade 6 was formed of SUS 304 of 0.1 mm thick, and arranged in abutment with the peripheral surface of developing roller 2 with a pressure ranging from 18 to 25 gf/cm. The difference in bias potential between developing roller 2 and doctor blade 6 was set to fall within the range of −100 to −110 V.

Example 1

Figure 3:
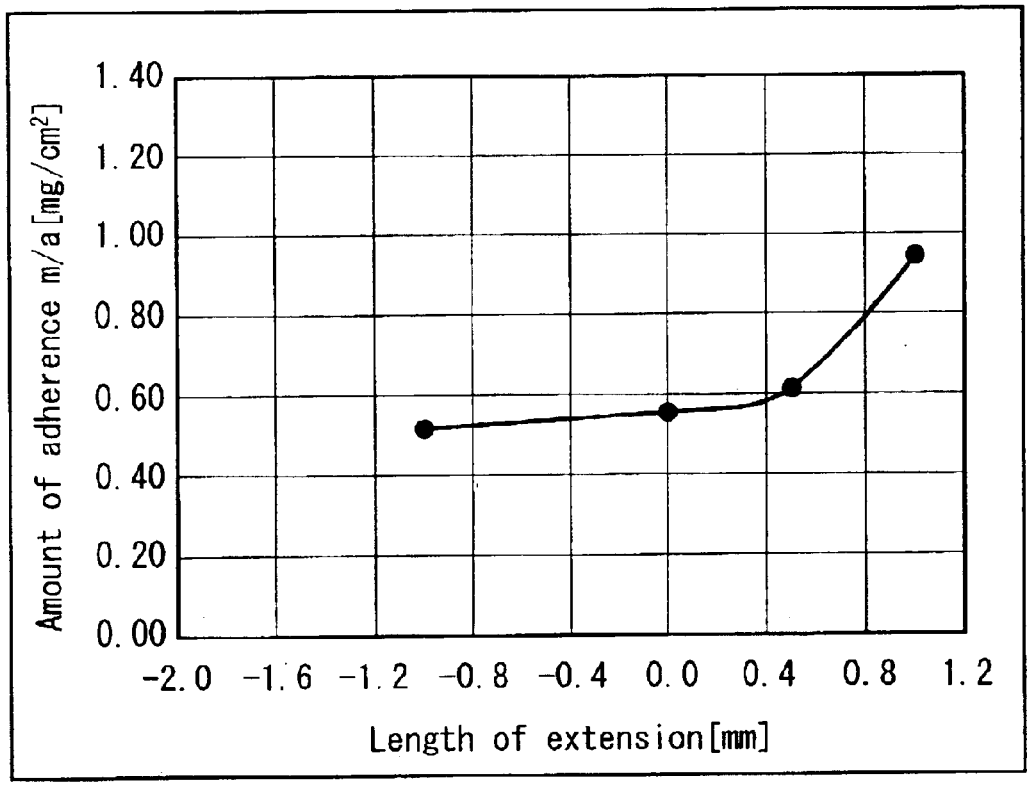
FIG. 3 is a chart showing the relationship (the angle θ=90°) between the amount of toner adherence and the extension Z of the doctor blade in a non-magnetic mono-component developing device according to the present invention.

FIG. 3 is a chart showing the relationship between the amount of toner adherence and the extension Z in the developing device 1*a* conditioned as in Table 1, where the angle θ of doctor blade 6 was set at 90°. Though the amount of toner adherence was stable when the length of extension falls in the range of −1.0 mm to +0.5 mm, the amount of toner adherence sharply increased when the length of extension was set at +1.0 mm. Setting the length of extension at +1.0 mm corresponds to the configuration where the open distance G is approximately equal to six times the means particle size of the toner. That is, it is considered that, if a space similar to that in the conventional hopper is created, an excessive amount of toner will flow in and push up the blade, and hence increase the thickness of the toner layer.

Figure 4:
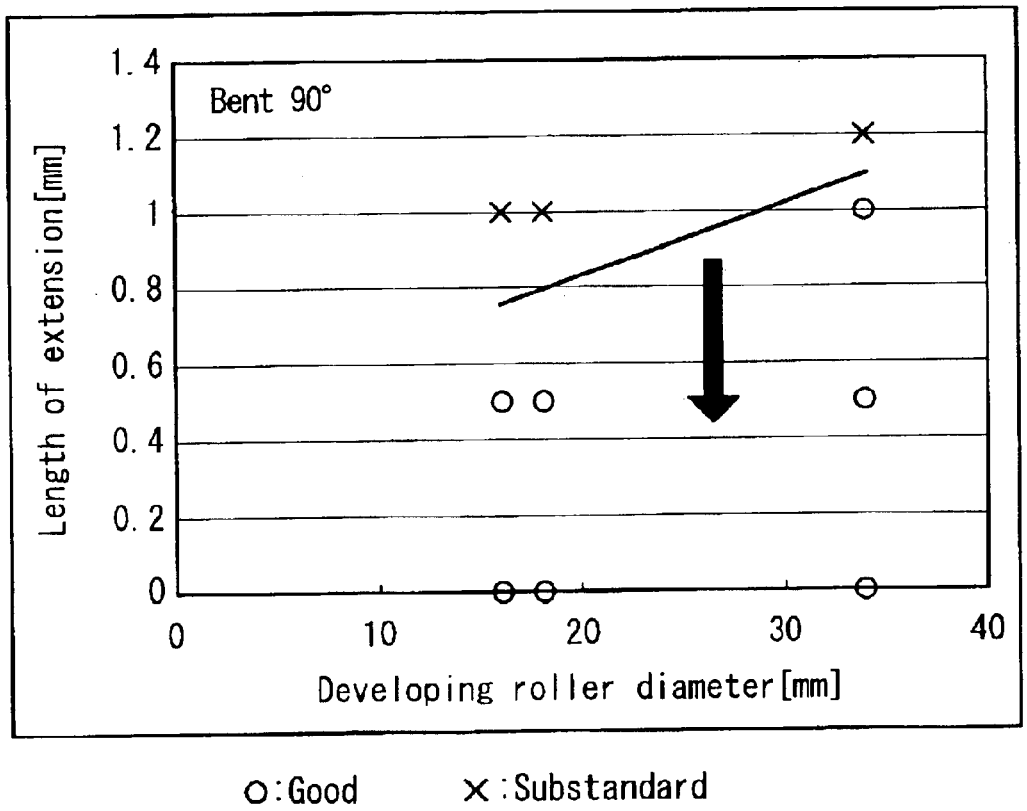
FIG. 4 is a chart showing the relationship between the diameter (2×Rr) of the developing roller and the length of extension Z in a non-magnetic mono-component developing device according to the present invention.

FIG. 4 is a chart showing the relationship between the diameter (2×Rr) of each developing roller and the length of extension Z when the above experiment was carried out in each of the developing devices 1*a*, 2 and 3*c*. With the length of extension Z was varied, 0.0 mm, 0.5 mm and 1.0 mm, the amount of toner adherence and toner charge-to-mass ratio were measured. As to the amount of toner adherence, the state where a stable layer, 1 to 1.5 particle thick, in terms of the mean particle size of the toner, is formed on the developing roller surface is determined as a good condition and indicated with o and the case where a toner layer having a greater thickness than that is indicated with x. The relational expression indicating the boundary line between o and x can be represented by the following relation (1):

$$Z \leqq [(Rr+4\times\phi t)^2-Rr^2]^{1/2} \quad (1).$$

That is, it was found that the stable toner layer thickness can be obtained when the open distance G is set to be equal to or smaller than four times of the mean toner particle size φt.

When the length of extension Z was set to be equal to or below 0, the blade was pushed up due to the space defined by the R-value or the radius of curvature of the bent portion, so that toner could pass therethrough and produce a toner layer of an appropriate thickness. However, the formation of the toner layer in this case was easily affected by the R-value and the surface properties of the bent portion.

Figure 5:
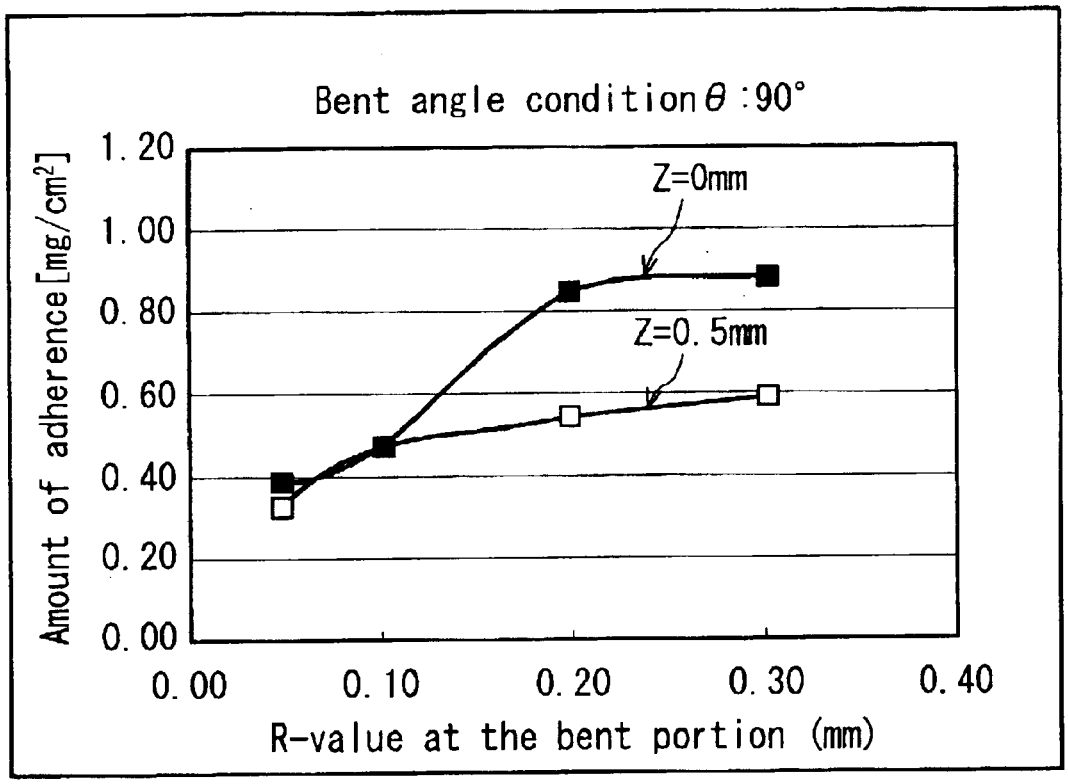
FIG. 5 is a chart showing the relationship (the angle θ=90°) between the R-value in the bent portion of the blade and the amount of toner adherence on the developing roller surface, in a non-magnetic mono-component developing device according to the present invention.

FIG. 5 is a simulated result showing the relationship between the R-value in the bent portion of the blade and the amount of toner adherence on the developing roller surface, under the condition of developing device 1*a*. This simulation was implemented based on the discrete particle modeling, which enables exact computation of the toner behavior. The discrete particle modeling is a conventional scheme for measurement, used and described in Japanese Patent Application Laid-open Hei 10 No.260159. (This particle behavior simulation scheme is a method that determines and represents time-dependent positions of the particles held in the container based on the container shape, the mixing and agitating conditions, the physical properties of particles and the physical properties of the container wall surface, whereby the amount of static electricity generated on the particles or the container wall surface by actuation of mixing and agitation is predicted based on the contact areas between the particles and between the particles and the container wall surface, which is determined based on the determined time-dependent particle positions.) The simulation was implemented assuming that the toner particles should have a cylindrical shape and a uniform particle size (8.8 $\mu$m: the average particle size) with an apparent density of 1200 kg/m$^3$.

From FIG. 5, a strong dependency of the amount of toner adherence on the radius of curvature (R) in the bent portion was found when the length of extension Z of the blade was 0.0 mm (Z=0.0), whereas the dependency was weak when the length of extension Z of the blade was 0.5 mm (Z=0.5). This simulated trend of the dependency of the amount of toner adherence on the length of extension Z of the blade and the R-value of the bent portion was also confirmed by actual experimentation. Thus, the longer the extension, the more influence of the radius of curvature (R) of the blade can be excluded and the more the amount of toner adherence and the toner charge-to-mass ratio can be stabilized. Accordingly, it is necessary to set the length of extension Z to be greater than 0. In conclusion, the length of extension Z should satisfy the following relation (2):

$$0<Z \leqq [(Rr+4\times\phi t)^2-Rr^2]^{1/2} \quad (2).$$

Thus, using data from Table 1, if a roller having a radius Rr equal to 18 millimeters is used with toner having an average particle size of 0.008 millimeters, Z will be less tan or equal to: $[((18+(0.032))^2-18^2]^{1/2}$ or 1.074 millimeters.

Example 2

FIG. 6 is a simulated result showing the relationship between the length L from the bent portion to the distal end and the amount of toner adherence on the developing roller surface, when the bent angle θ of the doctor blade is set at 90°. It is understood that the amount of toner adherence is stable when the length of the front part from the bent portion is equal to or greater than 0.5 mm, with the length of extension Z set at either 0.0 mm (Z=0.0) or at 0.5 mm (Z=0.5).

Figure 7:
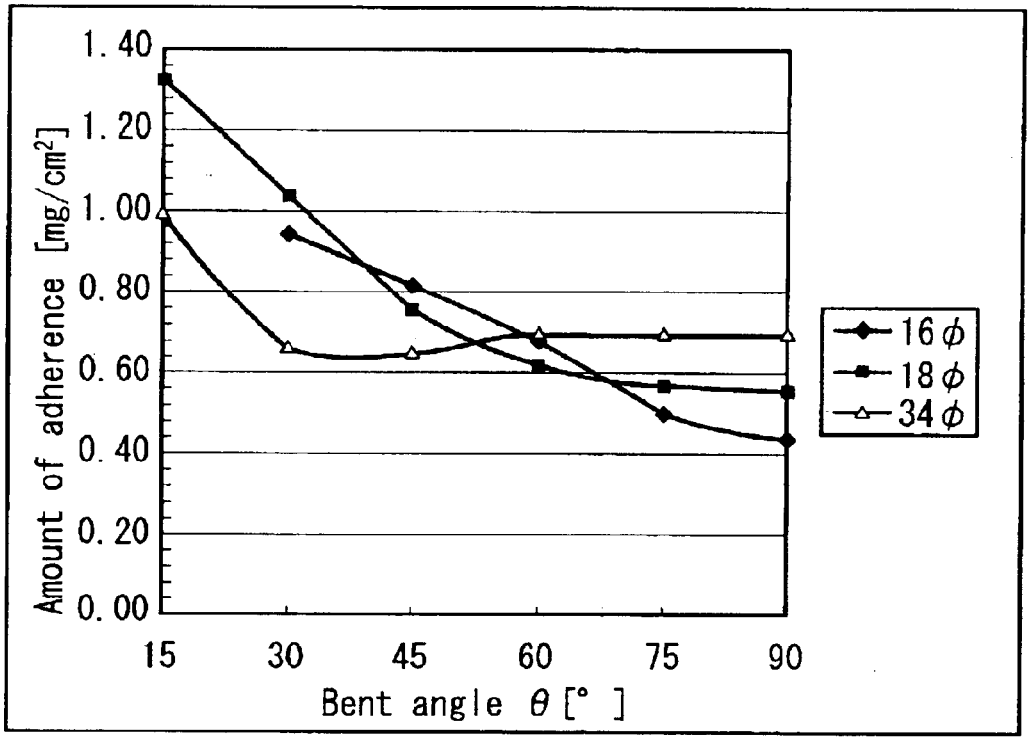
FIG. 7 is a chart showing the relationship between the bent angle θ of the doctor blade and the amount of toner adherence, in a non-magnetic mono-component developing device according to the present invention.

FIG. 7 is a chart showing the relationship between the bent angle θ of doctor blade 6 and the amount of toner adherence, in developing devices 1*a*, 1*b* and 1*c*. It is well known that the amount of toner adherence decreases as the bent angle θ is increased and comes to be stable above the certain threshold angle. All the developing devices showed much the same tendencies, and each device became stable with the amount of toner adherence corresponding to 1.0 to 1.5 times that of a single particle layer.

Figure 8:
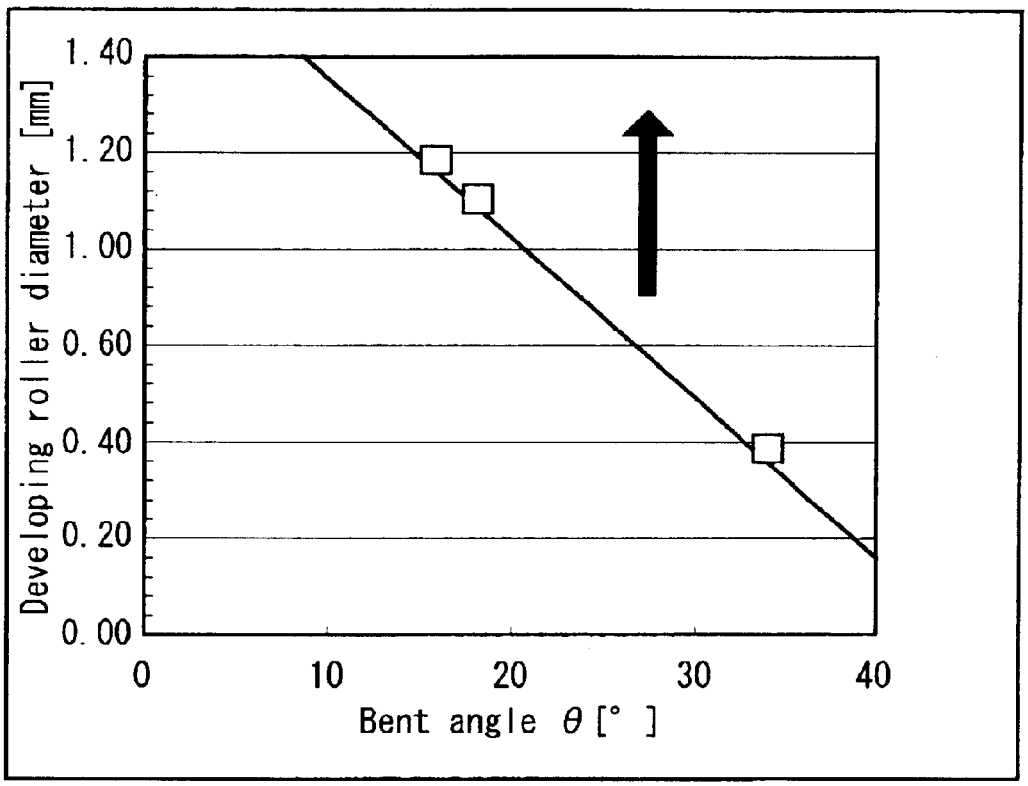
FIG. 8 is a chart showing the relationship between the developing roller's diameter and the minimum requirement of the bent angle of the doctor blade, in a non-magnetic mono-component developing device according to the present invention.

Next, consideration will be made on the developing roller's diameter 2Rr and the minimum requirement of the bent angle θ of the doctor blade for stabilizing the amount of toner adherence. FIG. 8 is a chart showing the relationship between the diameter 2Rr of developing roller 2 and the minimum requirement of bent angle θ. The minimum requirement of bent angle θ in this case differs depending on the developing roller's diameter. It is apparent from FIG. 8 that the bent angle θ can be made smaller as the developing roller's diameter becomes greater.

As a result, θ and 2Rr should satisfy the following relation:

$$\theta \leqq -2.5\times 2Rr+113 \quad (3)$$

where θ represents the bent angle of the distal end portion of the doctor blade and 2Rr the diameter of the developing roller in millimeters. Accordingly, setting the bent angle of the distal end portion of the blade to be lower than 90°, on the premise that the relation (3) holds, makes it possible to lessen the curve(R)-forming range at the bent portion, hence reducing the influence of the shaping accuracy (the surface properties such as burrs, etc. and variance of the curve(R)-forming area in the bent portion to the minimum.

As has been described heretofore, according to the non-magnetic mono-component developing device of the present invention, the doctor blade has, at its distal end, an extension projected in the tangent direction from the abutment S and a bent portion angled so as to be positioned away from the peripheral surface, and Z is specified so as to satisfy the following relation:

$$0<Z\leqq[(Rr+4\times\phi t)^2-Rr^2]^{1/2},$$

where Z represents the length of extension from the abutment point S to the bent portion, Rr the radius of the developing roller, and ϕt the mean particle size of the toner. As a result, it is possible to create a toner layer having a uniform thickness with uniform static charge characteristics across the full range of the image forming area on the peripheral surface of the developing roller, hence form images of good quality.

What is claimed is:

1. A non-magnetic mono-component developing device, comprising:

a developing roller for supplying non-magnetic mono-component toner layered on the peripheral surface thereof to the photoreceptor surface as it being rotated; and a doctor blade which is cantilevered at its proximal end, has a distal end as a free end, extended to the upstream side with respect to the direction of rotation of the developing roller and can regulate the thickness of the toner layer by abutting part of the side flat surface of the distal end portion against the peripheral surface of the developing roller, characterized in that the doctor blade has, at its distal end, an extension projected in the tangent direction from the abutment S and a bent portion (bent angle θ) angled so as to be positioned away from the peripheral surface, and Z is specified so as to satisfy the following relation:

$$0<Z\leqq[(Rr+4\times\phi t)^2-Rr^2]^{1/2},$$

where Z represents the length of the extension from the abutment point S to the bent portion, Rr the radius of the developing roller, and ϕt the mean particle size of the toner.

2. The non-magnetic mono-component developing device according to claim 1, wherein the radius of curvature (R-value) at the bent portion is set within the range of 0.1 to 0.3 mm, and the length L from the bent portion to the distal end is equal to 0.5 mm or greater.

3. The non-magnetic mono-component developing device according to claim 1, wherein the relation holds:

$$\theta\geqq -2.5\times 2Rr+113,$$

where θ represents the bent angle of the bent portion and 2Rr the diameter of the developing roller.

4. A developing device, comprising:

a photoreceptor roller;

a developing roller having a radius Rr for supplying non-magnetic mono-component toner having a mean particle size ϕt to the photoreceptor roller as said photoreceptor roller rotates; and a doctor blade connected to a support for regulating a thickness of a layer of toner on said developing roller, said doctor blade comprising a free end having a linear portion contacting said developing roller at a location S and an end portion angled away from said developing roller at an angle θ with respect to said linear portion and separated from said location S by a distance Z, wherein $0<Z\leqq[(Rr+4\phi t)^2-Rr^2]^{1/2}$.

5. The developing device of claim 4, wherein said doctor blade has a radius of curvature at the angled portion of 0.1 to 0.3 mm.

6. The developing device of claim 4, wherein said doctor blade free end has a distal end and a distance from said angled portion to said distal end is greater than or equal to 0.5 mm.

7. The developing device of claim 4, wherein $\theta\geqq -2.5\times 2Rr+113$.

8. The developing device of claim 4, wherein:

said doctor blade has a radius of curvature at the angled portion of 0.1 to 0.3 mm;

said doctor blade free end has a distal end and a distance from said angled to said distal end is greater than or equal to 0.5 mm; and wherein $\theta\geqq -2.5\times 2Rr+113$.

* * * * *